US008690127B2

(12) United States Patent
Patterman, Jr. et al.

(10) Patent No.: US 8,690,127 B2
(45) Date of Patent: Apr. 8, 2014

(54) VEHICLE LIFT SYSTEM ACCESSORY

(75) Inventors: James C. Patterman, Jr., Aurora, IL (US); Habib Jubran, Elburn, IL (US)

(73) Assignees: James C. Patterman, III, Glen Ellyn, IL (US); Daniel R. Patterman, Elgin, IL (US); Michael J. McGinnis, Aurora, IL (US); Cynthia K. Sutto, Waterville, OH (US)

( * ) Notice: Subject to any disclaimer, the term of this patent is extended or adjusted under 35 U.S.C. 154(b) by 247 days.

(21) Appl. No.: 13/103,442

(22) Filed: May 9, 2011

(65) Prior Publication Data

US 2012/0286222 A1 Nov. 15, 2012

(51) Int. Cl.
*B66D 1/14* (2006.01)

(52) U.S. Cl.
USPC ..... 254/342; 254/10 R; 254/10 B; 254/103

(58) Field of Classification Search
USPC ..... 254/323, 342–345; 211/1.51, 1.52, 1.56
See application file for complete search history.

(56) References Cited

U.S. PATENT DOCUMENTS

| | | | | |
|---|---|---|---|---|
| 3,467,359 | A | 9/1969 | Durand | |
| 4,954,011 | A | 9/1990 | Stenson | |
| 4,965,991 | A * | 10/1990 | Sauder | 56/119 |
| 5,287,821 | A | 2/1994 | Godbersen | |
| 5,433,850 | A | 7/1995 | Murray | |
| 6,010,154 | A | 1/2000 | Payne et al. | |
| 6,435,768 | B1 | 8/2002 | Mansfield | |
| 7,028,996 | B2 * | 4/2006 | Plath | 267/64.17 |
| 7,086,622 | B1 | 8/2006 | Whaley | |
| 7,377,485 | B2 | 5/2008 | Davis | |
| 2009/0072067 | A1 | 3/2009 | Lien | |

FOREIGN PATENT DOCUMENTS

GB 616560 1/1949

OTHER PUBLICATIONS

FLOE's Exclusive Easy-Level Leveling Legs Take the Work Out of Leveling Your Lift!, Docks & Lifts, website article, http://www.floeintl.com/docks.asb?pageName=docksLiftsEasyLevelLegs&sm=4, Dec. 21, 2009.

Heavy-Duty Electric Hoise The Winch does the Work, Hewitt Lifts & Roll-A-Dock, website article, http://www.hewitt-roll-a-dock.com/lifts07/winch_motors.html, May 2, 2011.

Boat Lifts, Dock Rite Inc., website article, http://www.dockriteus.com/boat_lifts.html, Dec. 21, 2009, Hutchinson, MN.

Marine Products Catalog, website article, http://www.boatliftsforless.com/rgc/images/RGC%20Marine%20Catalog%20-%20020607.pdf, 2007, Buffalo, NY.

* cited by examiner

*Primary Examiner* — Emmanuel M Marcelo
*Assistant Examiner* — Angela Caligiuri
(74) *Attorney, Agent, or Firm* — Valauskas Corder LLC

(57) ABSTRACT

An accessory that assists in operating vehicle lift systems, particularly an accessory that assists in the operation of a crank wheel of a vehicle lift system. The accessory is portable and quickly and easily assembled to the vehicle lift system. The accessory is activated using a power source, for example a cordless power source such as a cordless power drill. The crank wheel is engaged by the accessory and operated to raise and lower the platform component of the vehicle lift system.

18 Claims, 9 Drawing Sheets

VEHICLE LIFT SYSTEM ACCESSORY

FIELD OF THE INVENTION

The present invention relates generally to vehicle lift systems that include a manual crank wheel and more particularly to an accessory that assists in operating vehicle lift systems through engagement directly on the crank wheel.

BACKGROUND OF THE INVENTION

Vehicle lift systems are systems that raise and lower a vehicle. For purposes of this application, the vehicle lift system accessory according to the present invention is discussed herein with respect to a watercraft lift system, but a lift system for any vehicle is contemplated. In addition to a watercraft, vehicles include a bicycle, car, motorcycle, train, aircraft or any device designed or used to transport people or cargo.

Typically, watercraft lift systems are positioned on docks and include a platform component enforced by a support component that comprises a plurality of post elements. The platform component is moveable in a vertical direction to raise and lower the watercraft. A watercraft may include, for example, a boat, waverunner or submarine to name a few. The platform component is moveable through a winch system that is activated through the manual operation of a crank wheel.

One embodiment of a conventional lift system 10 is shown in FIG. 1. The lift system 10 includes a crank wheel 11 that is attached to one of a pair of post elements 12 of a base frame 13. A winch mechanism 14 connects the crank wheel 11 to a cable 15. Pulleys 16 and 17 guide the connection of the cable 15 to a platform component 18. Upon operation or rotation of the crank wheel 11, the cable 15 is actuated to raise or lower the platform component 18 in the vertical direction relative to the base frame 13. In this manner, a watercraft may be raised or lowered in the vertical direction through operation of the crank wheel 11. The crank wheel 11 of a conventional lift system 10 is typically operated by manually rotating the crank wheel 11 in the clockwise direction to raise the platform component 18 and counterclockwise to lower the platform component 18.

The manual operation of a crank wheel requires an exorbitant amount of human strength and energy. Therefore, operation of the crank wheel is sometimes problematic for those that do not possess the required strength and energy.

Although devices are available to assist in the operation of the crank wheel, these devices are power driven and require access to an alternating current power source. An example of one type of device can be found in U.S. Pat. No. 7,377,485. This device includes electrical wiring, which near water may pose a risk of electrocution during use. Other types of devices utilize direct current, but these devices involve time consuming installation and require expensive components such as a solar unit or batteries.

While these devices assist in operating a vehicle lift system, the need still remains for an accessory that assists in operating vehicle lift systems that overcomes the deficiencies of the prior art. The present invention satisfies this need.

SUMMARY OF THE INVENTION

The present invention is an accessory device that assists in operating vehicle lift systems. In particular, the present invention is an accessory device that attaches to a vehicle lift system to engage the crank wheel of the vehicle lift system. The accessory device may be positioned on either side of the crank wheel of the vehicle lift system.

The accessory device is activated using a power source, preferably a cordless power source, to operate the crank wheel in raising and lowering the platform component of the vehicle lift system. The accessory device is portable, and quickly and easily assembled to the vehicle lift system.

The accessory device according to the present invention does not include an electric motor and therefore eliminates the need for accessing power from any external electric power source including any associated wires. Instead of requiring an external electric power source, the accessory device is powered using a cordless power source, preferably a cordless power drill. A cordless power source such as a cordless drill eliminates the reliance on wiring and power from an external electric power source thereby expanding the usage area since access to an external electric power source is not required.

Regardless of the strength and energy of a user, the accessory device powered using a cordless power source allows the user to operate the crank wheel of the lift system. Some users that may benefit from use of the accessory device include seniors, children and even handicapped persons.

As mentioned above, the accessory device is described with respect to a watercraft lift system, but a lift system for any vehicle is contemplated. The accessory device includes an attachment component, an arm component, and a winch drive component that are connected together.

The attachment component of the accessory device engages with the watercraft lift system to fix the accessory device relative to the crank wheel of the watercraft lift system. In particular, the attachment component may be secured to a post element of the lift system and include a bracket element and locking element.

The arm component is secured within the bracket element by the locking element. The arm component is adjustable in length as well as angle. The arm component may adjust longitudinally through the bracket element to a desired length. The arm component may also adjust pivotally within the bracket element. This permits the accessory device of the present invention to be used with any size, type, and style crank wheel of various lift systems.

The winch drive component is connected to the arm component. The winch drive component includes an input shaft element that is connected to a gear assembly. The gear assembly is connected to a wheel element. The wheel element engages a crank wheel of the lift system, which rotate the crank wheel when the wheel element rotates. In particular, the input shaft element is actuated by a cordless power source that rotates portions of the gear assembly and hence the wheel element. The gear assembly provides a mechanical advantage to assist in rotation of the crank wheel. Accordingly, the crank wheel of the lift system may be readily rotated when the accessory device of the present invention is utilized.

The components of the accessory device may be made of any material, for example, iron, steel, stainless steel, bronze, aluminum, plastic, wood, polymer, polyvinyl chloride, or any combination thereof. The components may further be treated to prevent rusting and corrosion such as galvanized or anodized. For example, galvanized steel or anodized aluminum may be preferred when using the accessory device near salt water environments.

The present invention and its attributes and advantages will be further understood and appreciated with reference to the detailed description below of presently contemplated embodiments, taken in conjunction with the accompanying drawings and the claims.

DESCRIPTION OF THE DRAWINGS

The invention can be better understood by reading the following detailed description of certain preferred embodiments, reference being made to the accompanying drawings in which.

DETAILED DESCRIPTION OF THE INVENTION

Figure 1:
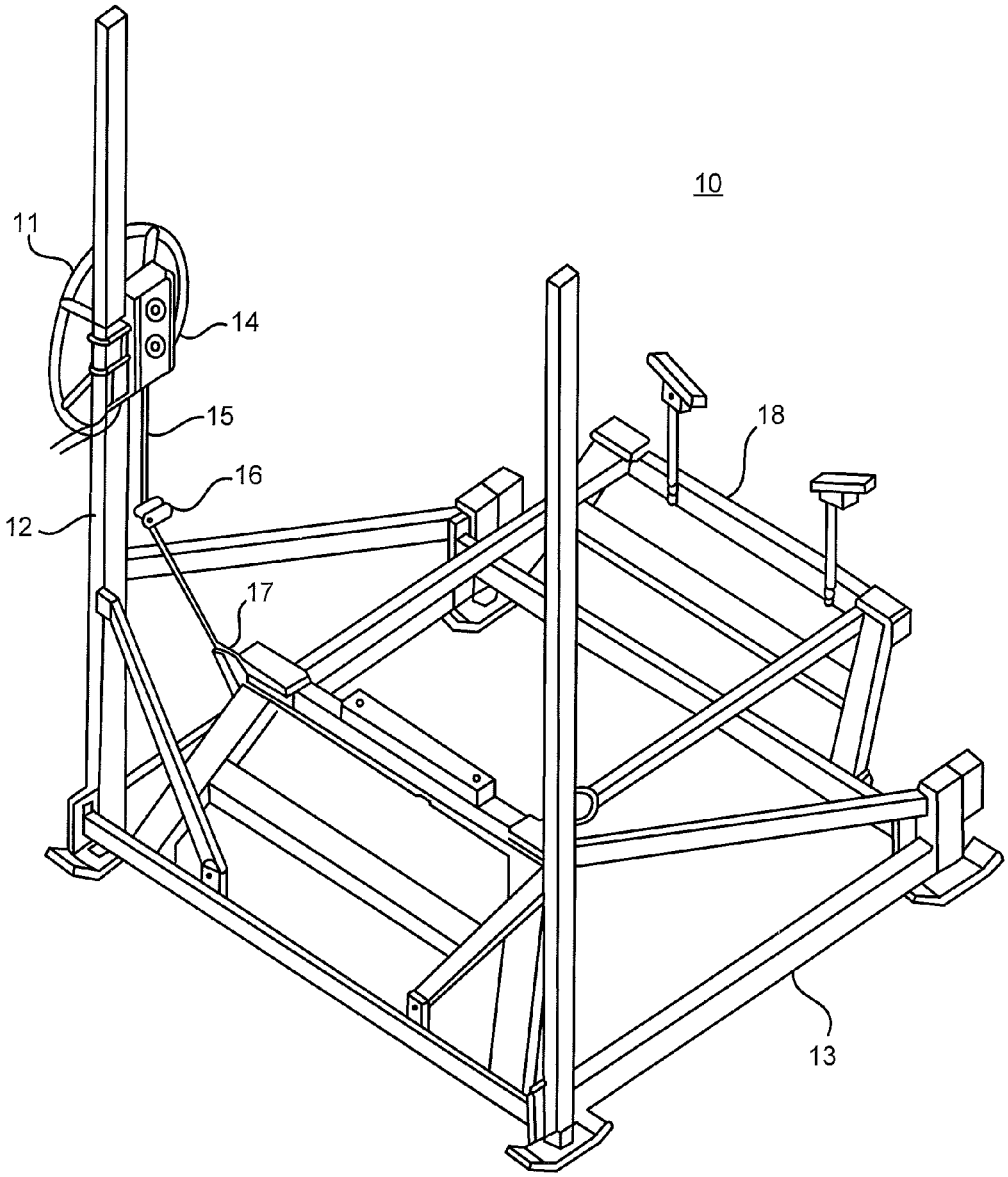
FIG. 1 PRIOR ART
FIG. 1 shows a perspective view of a lift system according to the prior art.

The present invention is directed to an accessory device for vehicle lift systems. In the embodiment described below the accessory is attached to a watercraft lift system, similar to the conventional watercraft lift system of FIG. 1. However, it is understood that the accessory may be used with any type of vehicle lift system having a crank wheel. The accessory according to the present invention assists in rotating the crank wheel.

Watercraft lift systems are often positioned adjacent to docks and include a platform component connected to a main frame that includes a plurality of post elements. The platform component is moveable in a vertical direction between a raised position and a lowered position through operation of the crank wheel. Generally, when the platform component is at the lowered position, a watercraft may float in water over the platform component. As the platform component raises by rotating the crank wheel, the platform component contacts the watercraft and raises the watercraft out of the water until the platform component is at the raised position. At the raised position, the watercraft may be stored and protected from damage such as from contact with the dock. Alternatively, when the platform component lowers to the lowered position from the raised position by rotating the crank wheel, the watercraft may float in water off the platform component for use in the water.

Furthermore, it is understood that the crank wheel is rotated in one direction such that the platform component achieves the lowered position from the raised position. The crank wheel is rotated in the opposite direction such that the platform component achieves the raised position from the lowered position.

Figure 2A:
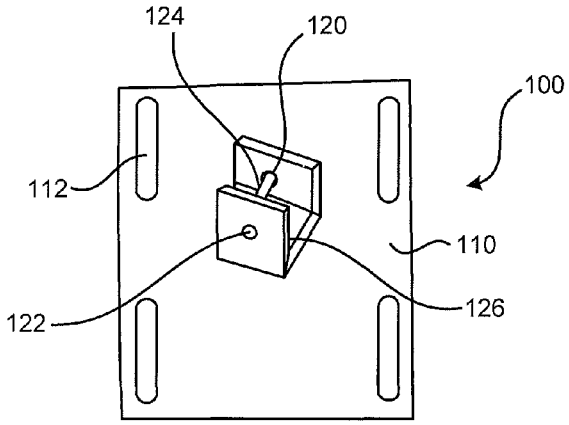
FIG. 2A and FIG. 2B illustrate perspective views of an attachment component of the accessory according to one embodiment of the present invention.
Figure 2B:
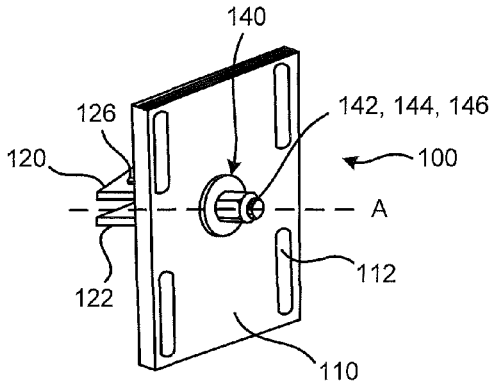

FIG. 2A and FIG. 2B illustrate an attachment component 100 of an accessory device 50 according to the present invention. The attachment component 100 includes a plate element 110 and a bracket element 120. The plate element 110 includes a plurality of slot portions 112 that assist in positioning the plate element 110 to a post element 12 (see FIG. 1). Specifically, the slot portions 112 are dimensioned to permit a connection element 130 (not shown) to wrap around the post element 12 to secure the attachment component 100. In one embodiment, the connection element 130 is a U-bolt 132 and fastener 134 (see FIG. 7 and FIG. 8).

Figure 3:
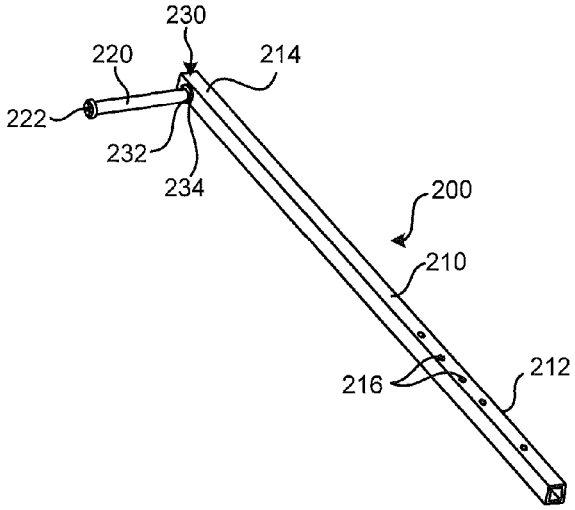
FIG. 3 illustrates a perspective view of an arm component of the accessory according to one embodiment of the present invention.

The bracket element 120 positions an arm component 200, described in detail with respect to FIG. 3. The arm component 200 is adjustable in length as well as angle through use of the bracket element 120. The bracket element 120 includes a through-hole element 122 into which a locking element 124 engages to position the arm component 200. The bracket element 120 is secured to the plate element 110 via a hardware element 140 such that bracket element 120 is pivotally adjustable. In one embodiment, the hardware element 140 comprises a threaded bolt 142, flat washer 144 and nut 146. The threaded bolt 142 is engaged by a flat washer 144 and nut 146 to secure the bracket element 120 to the plate element 110. The hardware element 140 allows the bracket element 120 to be pivotally adjusted about an axis A to position the accessory device 50. In one embodiment, the bracket element 120 is a clevis member 126 as shown in FIG. 2A and FIG. 2B.

FIG. 3 illustrates the arm component 200 of the accessory device 50 according to one embodiment of the present invention. The arm component 200 includes a lever bar element 210 and a pole element 220. The lever bar element 210 includes a first end 212 and a second end 214. A plurality of adjustment elements 216 is located at the first end 212. The plurality of adjustment elements 216 allows the arm component 200 to be adjusted in length to position the accessory device 50. The pole element 220 is connected to the lever bar element 210 at the second end 214. The pole element 220 is connected to the lever bar element 210 through use of a joining element 230. In one embodiment, the joining element 230 is a flanged bearing 232 and retaining ring 234. The pole element 220 is configured to receive the winch drive component 300 described in detail with respect to FIG. 4 and FIG. 5. The pole element 220 further includes a cap member 222. The cap member 222 secures the winch drive component 300 once positioned on the pole element 220 of the arm component 200.

Figure 4:
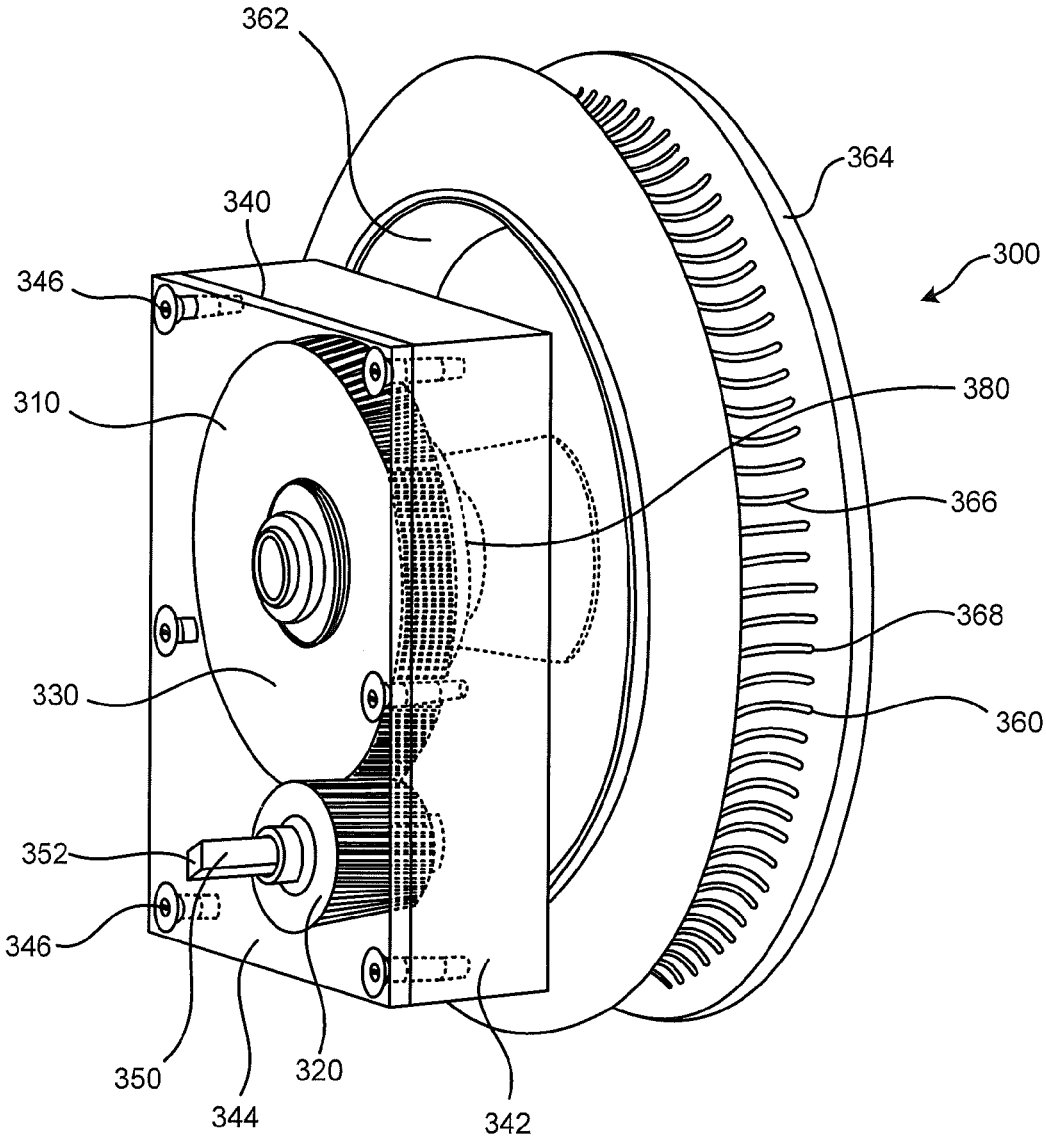
FIG. 4 illustrates a perspective view of a winch drive component of the accessory according to one embodiment of the present invention.
Figure 5:
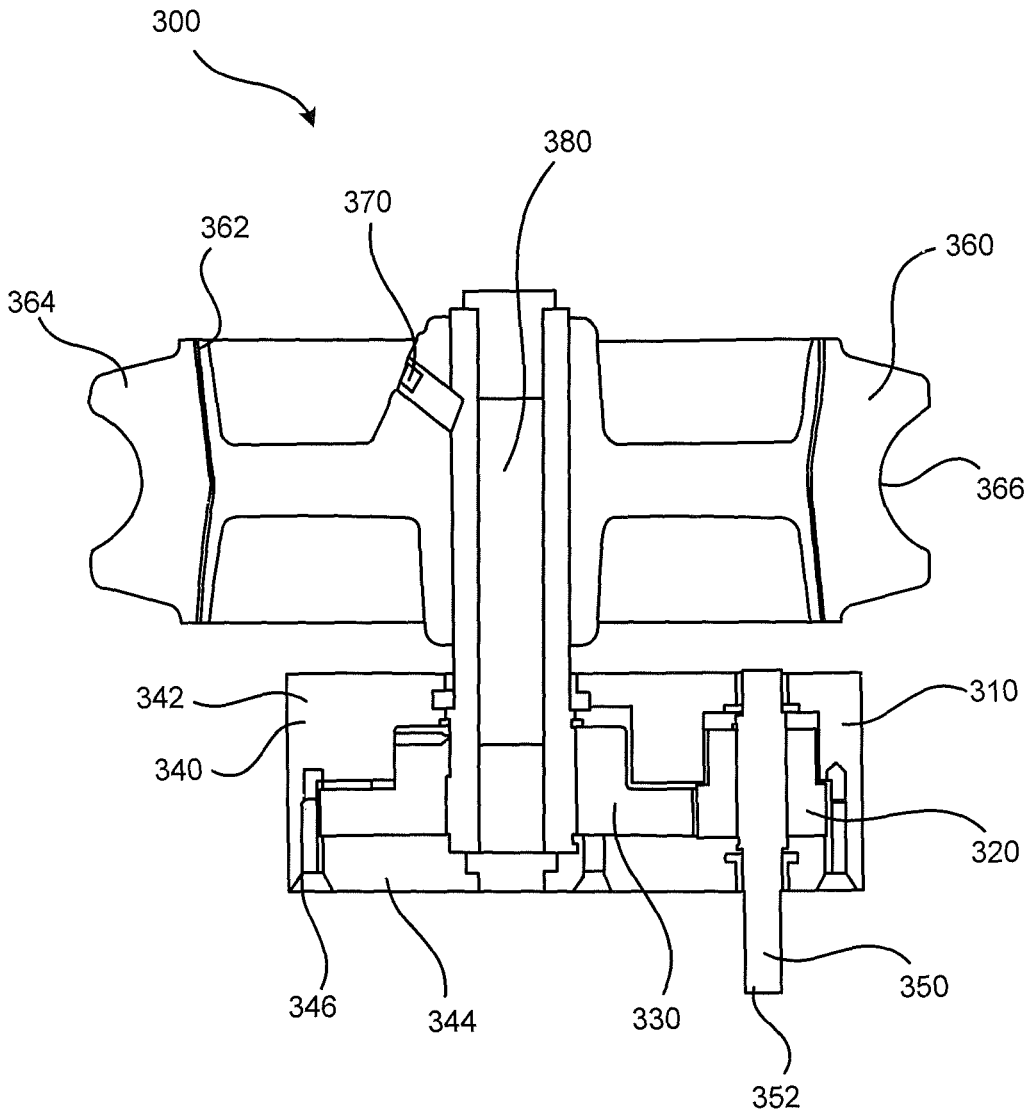
FIG. 5 illustrates a cross-sectional view of the winch drive component of FIG. 4.

The winch drive component 300 is shown in FIG. 4 and FIG. 5. The winch drive component 300 includes a gear element 310, input shaft element 350, and a wheel element 360. The gear element 310 includes a first gear portion 320 and a second gear portion 330. The first gear portion 320 and second gear portion 330 mesh together to transmit rotational motion. The gear portions 320, 330 are positioned within a housing element 340 to protect the gear portions 320, 330 from the external environment. In one embodiment, the housing element 340 includes a base element 342 and a cover element 344 secured together by a plurality of fastener elements 346.

The first gear portion 320 is engaged with the input shaft element 350. The input shaft element 350 includes a shank portion 352, which is configured to be received by a power source such as a cordless power source. In one embodiment, the shank portion 352 is a hex shank to be received by a chuck of a cordless power drill. However, it is contemplated that the shank portion 352 may be a square shank, taper shank triangular shank, special direct system ("SDS") shank, straight shank or a brace shank.

The second gear portion 330 is connected to the wheel element 360 via an axle element 380. The wheel element 360 includes a rim portion 362 that receives a tire portion 364. The tire portion 364 may be formed of rubber, however any material is contemplated such as any elastomer. The tire portion 364 includes a groove member 366 that configured to receive the crank wheel 11 of a conventional lift system 10 (see FIG. 1). The tire portion 364 may further include spaced lateral protrusion members 368 to facilitate the engagement of the tire portion 364 to the crank wheel 11.

The wheel element 360 may be locked in place by a wheel lock element 370 shown in FIG. 5. When the wheel lock element 370 is activated, movement of the axle element 380 is prevented. Therefore, the wheel element 360 remains stationary when the wheel lock element 370 is activated. Activating the wheel lock element 370 may be desirable to prevent the crank wheel 11 of the lift system 10 from moving. For example, when the wheel element 360 is engaged with the crank wheel lithe wheel lock element 370 may be activated to prevent the platform component 18 from being raised or lowered.

Figure 6A:
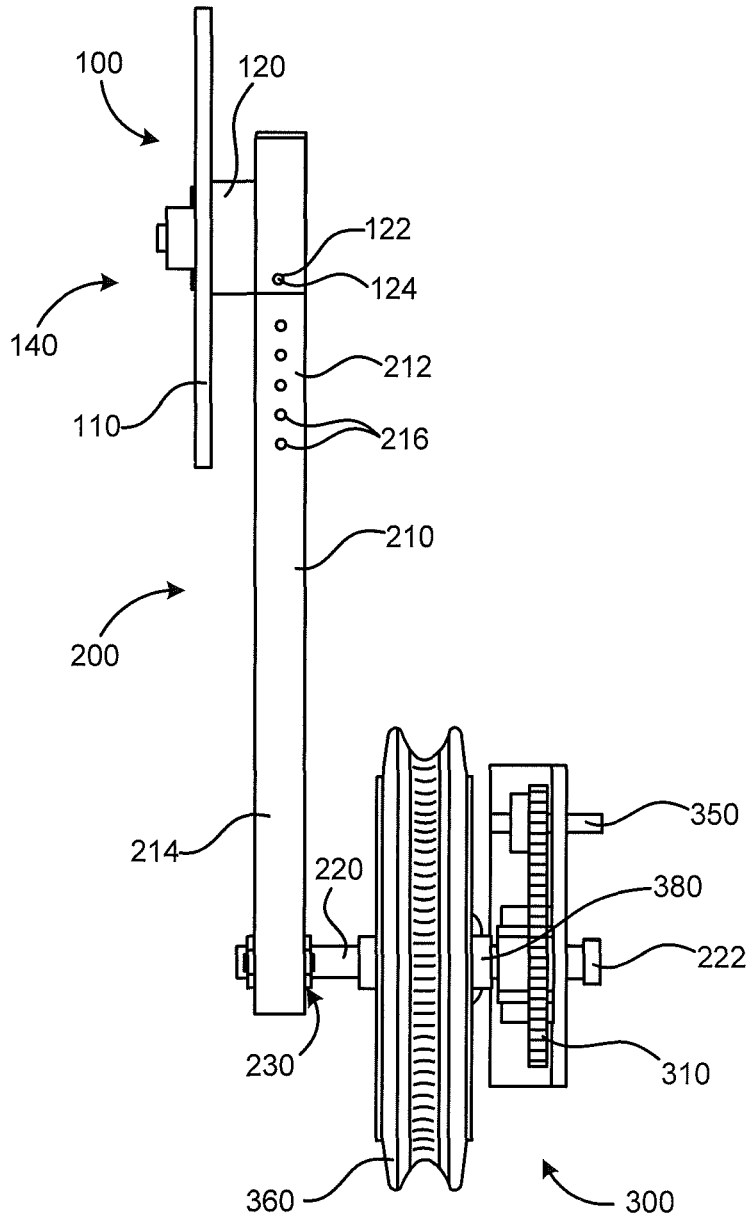
FIG. 6A and FIG. 6B illustrate perspective views of an accessory device according to one embodiment of the present invention.
Figure 6B:
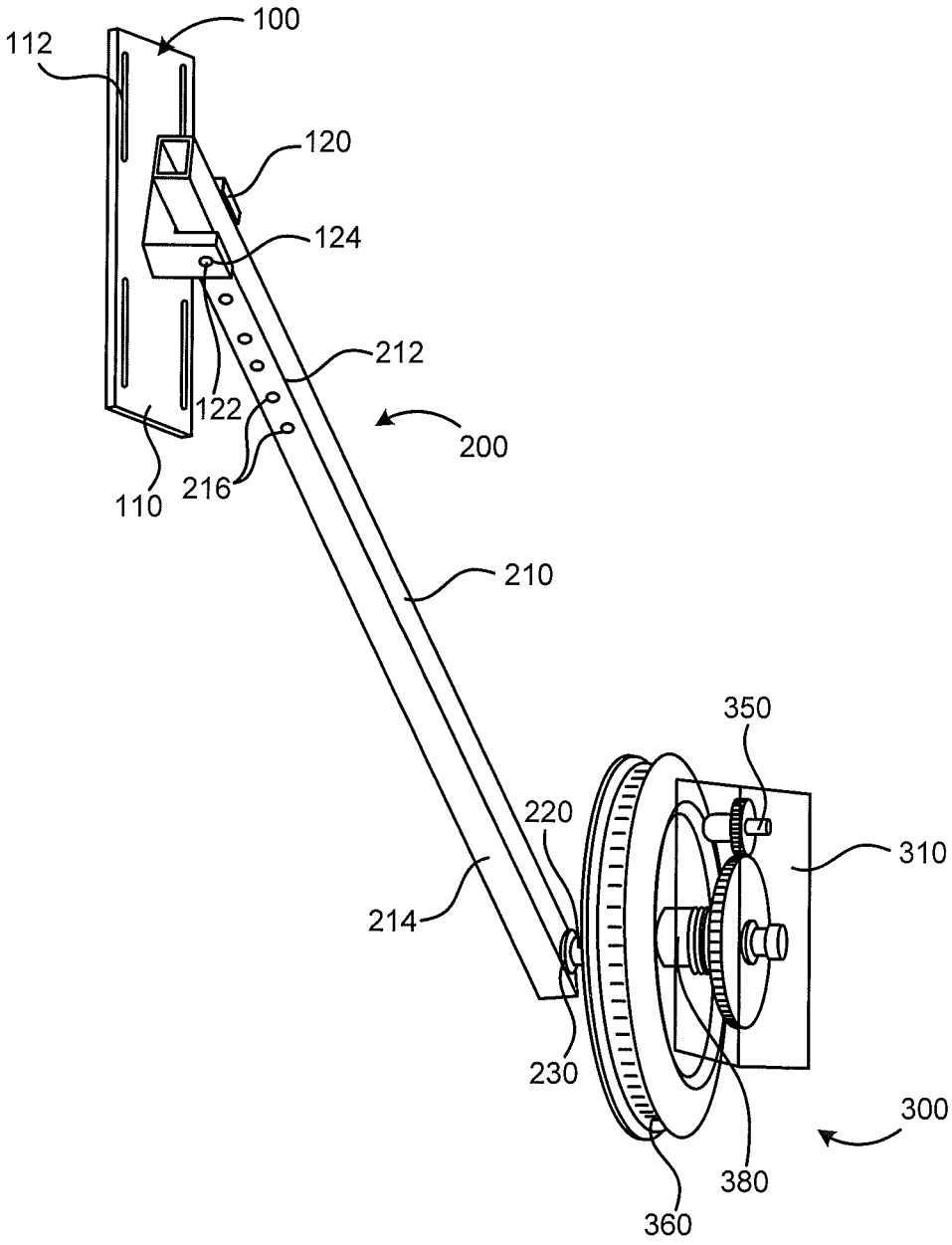

FIG. 6A and FIG. 6B illustrate a perspective view of the accessory device 50 according to one embodiment of the present invention. The arm component 200 is assembled with the attachment component 100. In particular, the lever bar element 210 engages with the bracket element 120. One of the plurality of adjustment elements 216 lines up with the through-hole element 122 of the bracket element 120 such that locking element 124 may be inserted. The locking element 124 inserts through the through-hole element 122 of the bracket element 120 and into one adjustment element 216 to position the arm component 200. The length of the arm component 200 may be adjusted by sliding the lever bar element 210 within the bracket element 120 to line up one of the plurality of adjustment elements 216 to the through-hole element 122 and inserting the locking element 124.

The winch drive component 300 is assembled with the arm component 200. Specifically, the wheel element 360 including gear element 310 is positioned on the pole element 220 of the arm component 200. The pole element 220 slideably engages with the axle element 380 including wheel element 360 and second gear portion 330. The cap member 222 secures the winch drive component 300 once positioned on the pole element 220 of the arm component 200.

Figure 7:
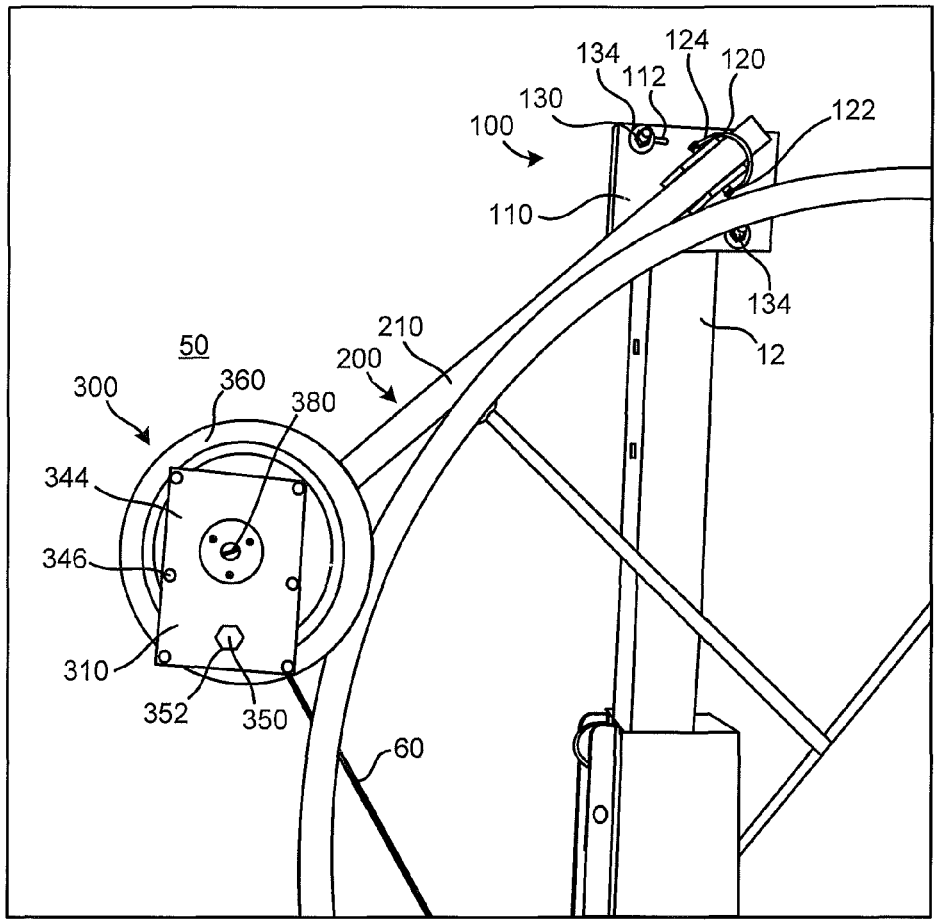
FIG. 7 illustrates a side view of the accessory device of FIG. 6 assembled to a lift system.
Figure 8:
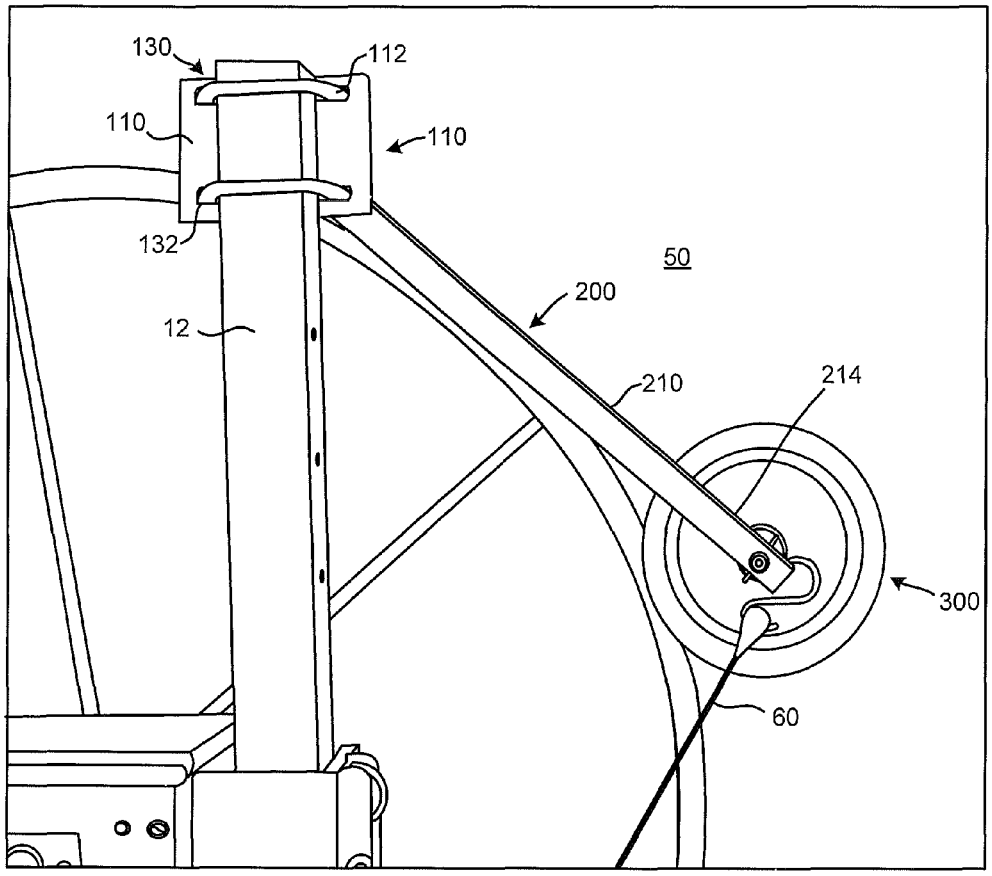
FIG. 8 illustrates a side view of the accessory device of FIG. 6 assembled to a lift system.
Figure 9:
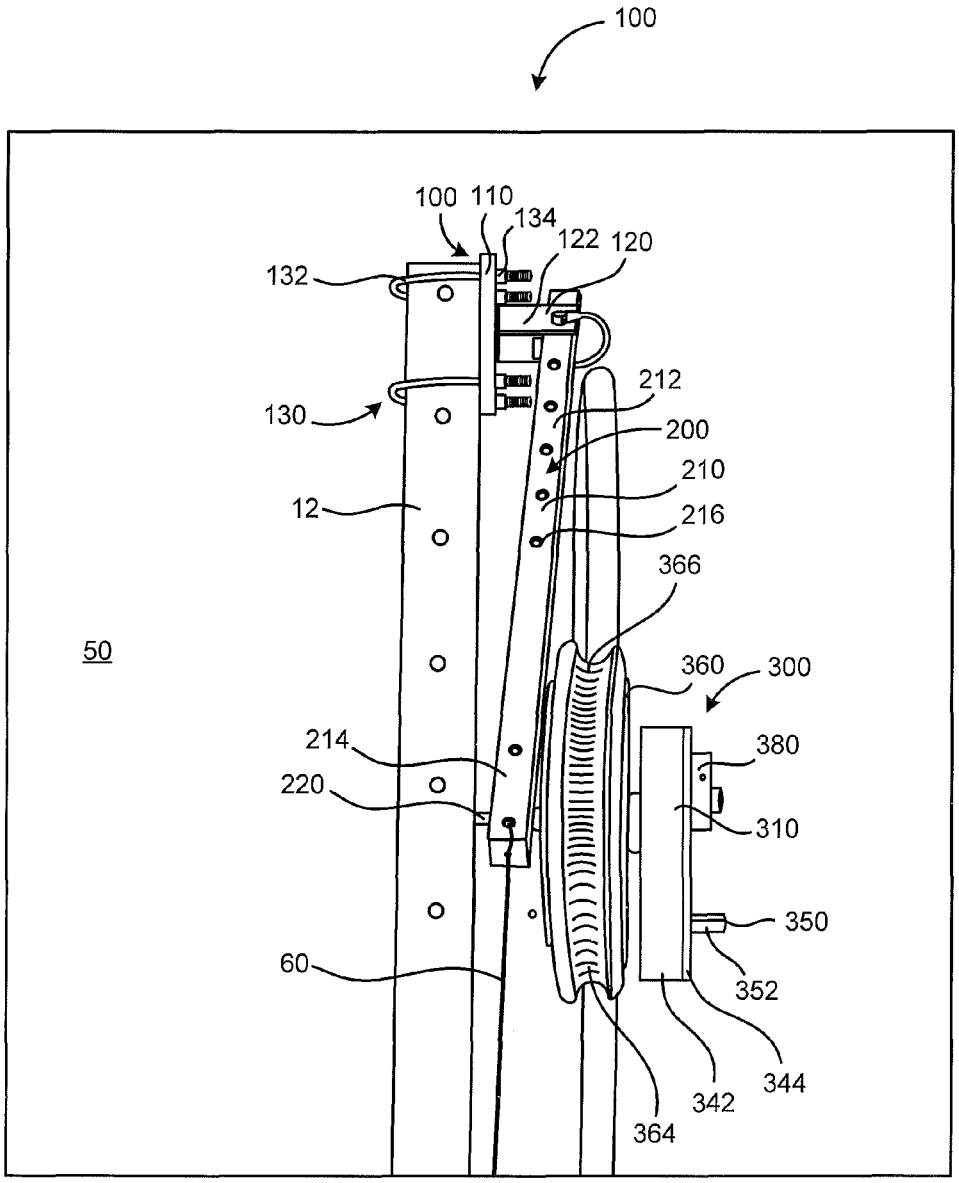
FIG. 9 illustrates a front view of the accessory device of FIG. 6 assembled to a lift system.

Turning now to FIG. 7 and FIG. 8, a perspective view and a side view, respectively, of one embodiment of an accessory device 50 is shown. The attachment component 100 is secured to a post element 12 of a lift system 10. Specifically, the plate element 110 is secured to the post element 12 with a connection element 130. More specifically, a U-bolt 132 wraps around the post element 12 and is positioned through the slot portions 112. The U-bolt 132 is secured to the plate element 110 with a fastener 134.

To align the wheel element 360 of the winch drive component 300 to the crank wheel 11 of the lift system 10, the arm component 200 is adjustable in length as well as angle such that the accessory device 50 may be used with different size, type, and style crank wheel of various lift systems.

As mentioned above with respect to FIG. 6, the locking element 124 inserts through the through-hole element 122 of the bracket element 120 and into one adjustment element 216 to position the arm component 200, specifically the lever bar element 210, at a desired length. The hardware element 140 allows the bracket element 120 to be pivotally adjusted to position the arm component 200, specifically the lever bar element 210, at a desired angle. The lever bar element 210 is positioned at a desired length and angle such that wheel element 360 aligns with the crank wheel 11 of the lift system 10.

A biasing mechanism 60 may be used with the accessory device 50 to assist in positioning the wheel element 360 against a crank wheel 11 of the lift system 10. In the present embodiment as shown in FIG. 7 and FIG. 8, the biasing mechanism 60 is an elastic cord, and in particular a rubber bungee cord. However, it is envisioned that different types of biasing mechanisms 60 such as a spring may be implemented with the accessory device 50 of the present invention.

The accessory device 50 is positioned such that the groove member 366 of the wheel element 360 receives the crank wheel 11 of the lift system 10. When the wheel element 360 is positioned against the crank wheel 11 by the biasing mechanism 60, the friction between the groove member 366 of the tire portion 364 of the wheel element 360 and the crank wheel 11 facilitates operation or rotation of the crank wheel 11 as the wheel element is rotated.

The accessory device 50 is configured to assist with rotation of a crank wheel 11 of a watercraft lift system 10 to raise or lower the platform component 18 of a lift system 10 to a raised position or lowered position, respectively. In particular, the accessory device 50 rotates the crank wheel to raise or lower the platform component 18 of the lift system 10 by using a cordless power source (not shown).

The input shaft element 350 is activated by the cordless power source. Accordingly, when a power source such as a cordless power drill activates the input shaft element 350, a mechanical advantage is applied to the wheel element 360 via the gear element 310. Specifically, rotation of the input shaft element 350 causes the first gear portion 320 and second gear portion 330 to rotate. The first gear portion 320 and second gear portion 330 mesh together to transmit rotational motion. The second gear portion 330 connects to the wheel element 360 through the axle element 380 such that when the second gear portion 330 rotates, the wheel element 360 rotates thereby rotating the crank wheel 11 of the lift system 10.

The crank wheel 11 is rotated in one direction such that the platform component 18 achieves the lowered position from the raised position. The crank wheel 11 is rotated in the opposite direction such that the platform component 18 achieves the raised position from the lowered position. When the accessory device 50 of the present invention is used, a cordless power source such as a cordless power drill is operated in the forward direction to activate the input shaft element 350 in the clockwise direction, thereby causing the wheel element 360 to rotate counterclockwise and crank wheel 11 to rotate clockwise to raise the platform component 18 of a lift system 10. The cordless power drill is operated in the reverse direction to activate the input shaft element 350 in the counterclockwise direction, thereby causing the wheel element 360 to rotate clockwise and crank wheel 11 to rotate counterclockwise to lower the platform component 18 of a lift system 10.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. An accessory device for operating a crank wheel of a vehicle lift system using a cordless power drill, the vehicle lift system including a base frame with at least one post element and a platform component, the accessory device comprising:

an attachment component configured to assemble to the at least one post element of the vehicle lift system;

an arm component including a first end and a second end, said first end of said arm component connected to said attachment component; and a winch drive component connected to said second end of said arm component, said winch drive component including a gear element, an input shaft element including a hex shank portion, and a wheel element, said input shaft element configured to be received and activated by the cordless power drill such that said gear element rotates said wheel element in a desired direction, wherein said wheel element is configured to receive the crank wheel of the vehicle lift system.

2. The accessory device for operating a crank wheel of a vehicle lift system of claim 1, wherein said arm component is adjustable to align said wheel element with the crank wheel of the vehicle lift system.

3. The accessory device for operating a crank wheel of a vehicle lift system of claim 2, wherein said arm component is adjustable in length.

4. The accessory device for operating a crank wheel of a vehicle lift system of claim 2, wherein said arm component is adjustable in angle.

5. The accessory device for operating a crank wheel of a vehicle lift system of claim 1, wherein said attachment component comprises a plate element including a plurality of slot portions dimensioned to receive a connection element to position the accessory device on the at least one post element.

6. The accessory device for operating a crank wheel of a vehicle lift system of claim 1, wherein said attachment component comprises a bracket element including a through-hole element into which a locking element engages to position said arm component.

7. The accessory device for operating a crank wheel of a vehicle lift system of claim 1, wherein said attachment component comprises a bracket element that is pivotally adjustable about an axis.

8. The accessory device for operating a crank wheel of a vehicle lift system of claim 1, wherein said arm component further comprises a lever bar element having a first end and a second end, said first end including a plurality of adjustment elements.

9. The accessory device for operating a crank wheel of a vehicle lift system of claim 1, wherein said arm component further comprises a lever bar element having a first end and a second end, said second end including a pole element.

10. The accessory device for operating a crank wheel of a vehicle lift system of claim 9, wherein said pole element receives said winch drive component.

11. The accessory device for operating a crank wheel of a vehicle lift system of claim 1, wherein said gear element comprises a first gear portion connected to a second gear portion, said first gear portion being sized smaller than said second gear portion.

12. The accessory device for operating a crank wheel of a vehicle lift system of claim 1 further comprising a biasing mechanism to assist in positioning said wheel element against the crank wheel of the vehicle lift system.

13. The accessory device for operating a crank wheel of a vehicle lift system of claim 12, wherein said biasing mechanism is a rubber bungee cord.

14. The accessory device for operating a crank wheel of a vehicle lift system of claim 1, wherein said wheel element includes a groove portion configured to receive the crank wheel of the vehicle lift system.

15. An accessory device for rotating a crank wheel of a watercraft lift system using a cordless power drill, the watercraft lift system including a base frame with at least one post element and a platform component, the accessory device comprising:

an attachment component comprising a plate element and a bracket element, said plate element including at least one slot portion dimensioned to receive a connection element to position the accessory device to the at least one post element and said bracket element including a through-hole element;

an arm component comprising a lever bar element having a first end and a second end, said first end including a plurality of adjustment elements and said second end having a pole element, wherein said lever bar element is positioned within said bracket element and one adjustment element of said plurality of adjustment elements aligns with said through-hole element and a locking element engages said through-hole element and said one adjustment element to position said arm component;

a winch drive component connected to said pole element, said winch drive component including an input drive shaft element comprising a hex shank portion, a gear element, and a wheel element, said wheel element receives the crank wheel of the watercraft lift system; and a biasing mechanism configured to assist in positioning said wheel element against the crank wheel of the watercraft lift system, said input drive shaft element configured to be received and activated by the cordless power drill such that said gear element rotates in a desired direction thereby rotating said wheel element and the crank wheel of the watercraft lift system.

16. The accessory device for rotating a crank wheel of a watercraft lift system of claim 15, wherein said biasing mechanism is an elastic cord.

17. The accessory device for rotating a crank wheel of a watercraft lift system of claim 15, wherein said bracket element is pivotally adjustable.

18. The accessory device for rotating a crank wheel of a watercraft lift system of claim 15, wherein said arm component is adjustable in length and angle.

* * * * *